United States Patent [19]

Jahraus

[11] 4,017,195

[45] Apr. 12, 1977

[54] WRITING IMPLEMENT AND METHOD OF MANUFACTURING THE SAME

[75] Inventor: Rudi Jahraus, Keltern Ellmendingen, Germany

[73] Assignee: Moriz Hausch GmbH, Pforzheim, Germany

[22] Filed: Jan. 5, 1976

[21] Appl. No.: 646,875

[30] Foreign Application Priority Data

Jan. 25, 1975 Germany ..... 7502204[U]

[52] U.S. Cl. ..... 401/104

[51] Int. Cl.[2] ..... B43K 24/08

[58] Field of Search ..... 401/104–106, 401/109–116

[56] References Cited

UNITED STATES PATENTS

| | | | |
|---|---|---|---|
| 3,288,114 | 11/1966 | Ritter | 401/104 |
| 3,637,316 | 1/1972 | Bross | 401/107 X |

FOREIGN PATENTS OR APPLICATIONS

| | | | |
|---|---|---|---|
| 680,799 | 1/1965 | Italy | 401/112 |

*Primary Examiner*—Lawrence Charles

[57] ABSTRACT

The implement comprises a barrel formed with a slot, a retaining clip carried by said barrel and disposed on the outside thereof, and a clip extension which is integral with said clip and extends in said barrel and has a laterally bent lower end portion extending into said slot. Said extension is formed with a recessed ball seat. A pressure-operable mechanism comprises a slider slidably mounted in said barrel and formed with a heart-shaped groove, and a ball seated in said ball seat and protruding into said groove. To assemble the implement, the clip extension and slider, with the ball seated in said ball seat and protruding into said groove, are jointly inserted into said barrel until said laterally bent end portion enters said slot.

1 Claim, 2 Drawing Figures

WRITING IMPLEMENT AND METHOD OF MANUFACTURING THE SAME

Figure 1:
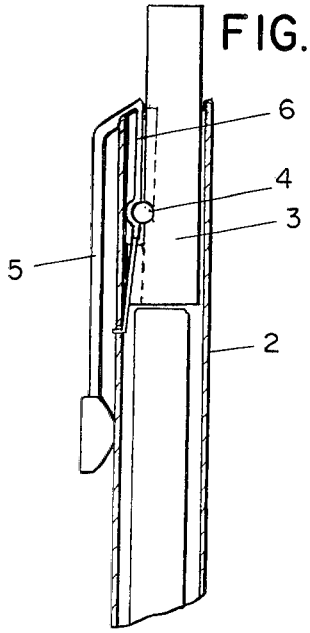

This invention relates to a writing implement which comprises a pressure-operable mechanism and a retaining clip.

Writing implements are known in which a refill is extended from the conical tip portion of the barrel of the implement in response to pressure applied to a pushbutton which protrudes from that end of the writing implement which is remote from the refill, and the refill is subsequently locked in position. In response of another application of pressure to the push-button, the refill is unlocked and is retracted into the barrel by a tension spring which has been stressed during the extending stroke. In the known writing implements, the refill is locked and unlocked by the cooperation of a projection on the barrel or on the slider, which is moved by the push button, with a heart-shaped groove formed in the slider or barrel, respectively.

To facilitate the assembling, it is known to provide writing implements which have a retaining clip, the clip has an extension fitted into the barrel to secure the clip to the barrel, and the heart-shaped groove is provided on the outside of a clip extension rather than on the inside surface of the barrel. In such implements, the projection consists of a headed pin, which has a hemispherical free end portion and which is movable in a slot formed of the clip extension.

Other known writing implements comprise a retaining clip and instead of a headed pin comprise a loose ball, which lies in a recessed ball seat which has been impressed into the clip extension. In that known writing implement the clip extension is disposed in an aperture which is formed in the barrel and is held in said aperture by bent lugs which extend from the edge of the barrel.

It is an object of the invention so to design such writing implement that it can be assembled more easily and particularly to eliminate the aperture, which weakens the sleeve, and the subsequent bending of the fixing lugs.

In a writing implement according to the invention, this object is accomplished in that the ball is fixed to the clip extension by a drop of grease and the clip extension with said ball and the slider are jointly fitted from above into the barrel until the laterally bent end portion of the clip extension snaps into a slot, as is known for writing implements in which a projection is formed on the clip extension.

The drawing shows diagrammatically and partly in cross-section a preferred embodiment of the writing implement according to the invention.

Figure 2:
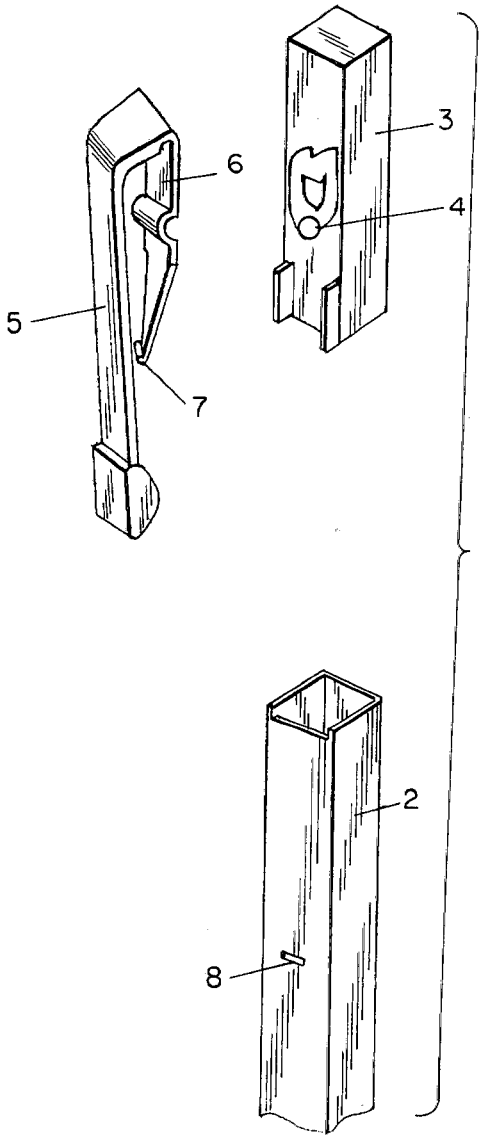

In the drawing,

FIG. 1 is a longitudinal sectional view showing the pressure-operable mechanism of the pin, and FIG. 2 is a perspective view showing the sleeve, the clip, and the slider before the assembling operation.

This drawing shows a barrel 2, a slider 3, a clip 5, a clip extension 6 and a ball 4. When the parts are being assembled, the laterally bent end 7 of the clip extension 6 snaps into the slot 8 of the barrel 2, the extension 6 being formed with a recessed ball seat.

What is claimed is:

1. A writing implement which comprises a barrel formed with a slot, a retaining clip carried by said barrel and disposed on the outside thereof, a clip extension which is integral with said clip and extends in said barrel and has a laterally bent lower end portion extending into said slot, said extension being formed with a recessed ball seat, and a pressure-operable mechanism which comprises a slider slidably mounted in said barrel and formed with a heart-shaped groove, and a ball seated in said ball seat and protruding into said groove.

* * * * *